US009574755B1

(12) United States Patent
Gutierrez

(10) Patent No.: US 9,574,755 B1
(45) Date of Patent: Feb. 21, 2017

(54) SYSTEM AND METHOD OF CREATING A DECORATIVE PANEL

(71) Applicant: Faber Gutierrez, New Castle, DE (US)

(72) Inventor: Faber Gutierrez, New Castle, DE (US)

( * ) Notice: Subject to any disclaimer, the term of this patent is extended or adjusted under 35 U.S.C. 154(b) by 19 days.

(21) Appl. No.: 14/885,317

(22) Filed: Oct. 16, 2015

(51) Int. Cl.

| | |
|---|---|
| ***F21S 4/00*** | (2016.01) |
| ***F21V 21/005*** | (2006.01) |
| ***F21V 23/06*** | (2006.01) |
| *F21Y 101/02* | (2006.01) |
| *F21Y 103/00* | (2016.01) |
| *F21Y 113/00* | (2016.01) |
| *F21W 121/00* | (2006.01) |

(52) U.S. Cl.
CPC ..... *F21V 21/005* (2013.01); *F21V 23/06* (2013.01); *F21W 2121/00* (2013.01); *F21Y 2101/02* (2013.01); *F21Y 2103/003* (2013.01); *F21Y 2113/005* (2013.01)

(58) Field of Classification Search
CPC .... F21V 21/005; F21V 23/06; F21W 2121/00; F21Y 2101/02; F21Y 2103/003; F21Y 2113/005
USPC ..... 362/219
See application file for complete search history.

(56) References Cited

U.S. PATENT DOCUMENTS

| | | | | |
|---|---|---|---|---|
| 5,564,818 | A * | 10/1996 | Grossman | F21S 2/00 362/216 |
| 5,565,728 | A * | 10/1996 | Jung | F21S 2/00 313/318.02 |
| 6,422,891 | B1 * | 7/2002 | Huang | F21V 23/06 362/249.01 |
| 2007/0091596 | A1 * | 4/2007 | Grossman | F21S 2/00 362/217.09 |
| 2009/0047863 | A1 * | 2/2009 | Capriola | A63H 33/042 447/91 |
| 2014/0233232 | A1 * | 8/2014 | Radermacher | F21S 2/005 362/249.01 |

* cited by examiner

*Primary Examiner* — Bryon T Gyllstrom
(74) *Attorney, Agent, or Firm* — Ruben Alcoba, Esq.

(57) ABSTRACT

A system and method of creating a decorative panel enables the creation of a decorative panel through a unique arrangement of illuminating blocks. The blocks are arranged to form a decorative panel. The blocks have an internal channel that contains light emitting diodes and a central conductive member. The diodes can be adjusted and removed to achieve a desired pattern or message without removing any of the blocks. The diodes and central conductive member are easily accessible from one side of the blocks by sliding them in and out for interchanging diodes or maintenance of the wires. The decorative effect on the panel may be constantly regenerated by interchanging diodes from within individual blocks, without having to move the block. This is possible because the diodes are disposed internally in the blocks. Thus, the illuminating effect from within each block is manipulated to create a desired decorative effect.

20 Claims, 9 Drawing Sheets

SYSTEM AND METHOD OF CREATING A DECORATIVE PANEL

BACKGROUND

The present invention describes a system and method of creating a decorative panel. The decorative panel is comprised of a plurality of illuminating blocks that are arranged to form an illuminating pattern or message. The blocks have an internal channel that contains light emitting diodes and wires. The illumination from the light emitting diodes is adjustable so as to form the pattern or message without having to remove a block from the decorative panel. The diodes and wires are easily accessible from the edge of the panel by accessing an end frame and sliding the series of frames in and to interchange diodes or maintenance the wires.

The inventor was familiar with the tile, glass/acrylic panel, and brick industry. The inventor knew that panels and blocks used to construct walls and floors were becoming increasingly popular to allow passage of light transmission. The inventor observed that there had been developments to light the tiles to show off their colors. One type of lighting noticed by the inventor included glass bulbs. However, the inventor quickly recognized that bulbs do not have a long life and removing such bulbs was expensive and time consuming. The inventor saw that another way to provide lighting for these tiles was to use fiber optics that are powered by a halogen light sources. However, fiber optic lighting systems are expensive to install and require a lot of energy to light the tiles.

Most importantly though, the inventor recognized that glass block construction units, formed into wall panels were never self-illuminated, but instead allowed light to pass through the glass block unit from a source exterior to the glass block unit. Natural daylighting, or an electrical source of light entered through one side of the glass block unit and exited through the other remaining side. Sometimes, to provide interesting special effects, neon lights, or other electric lighting devices were installed independently behind a wall of glass block. These prior art uses of electric lighting required their own form of support, so that in essence, the glass block wall and the electric lighting were abutted adjacent to each other, often in a crowded installation, whereby it was difficult to service the electric lighting adjacent to the glass block wall.

Also, the type of electric light chosen to illuminate the glass block wall, had its own inherent shape, for example, neon lights are usually provided in long narrow tubes of light, or fluorescent tubes in a somewhat larger format, but also long narrow tubes, and so these shapes of lighting fixtures were visible through the glass block wall, creating hot spots thus betraying their hybrid nature, as separate from the glass block and therefore not coordinating aesthetically with the rectilinear, cellular nature of a glass block wall.

The inventor performed some research to discover possible light sources. The inventor learned that LEDs provide a wide range of advantages over conventional light bulbs. First, they are long-lasting. LED devices last about 10 times as long as compact fluorescent bulbs, and as much as 133 times longer than typical incandescent bulbs. Because these devices last for years, maintenance and replacement costs are greatly reduced. Also, LEDs are durable, and hold up well to jarring and bumping. Since LEDs do not have a fragile filament, they are not damaged under circumstances in which an incandescent bulb would be broken. Additionally, LEDs run cool, which reduces heat build-up.

Consequently, the inventor decided that light emitting diodes (LED's) could be used as a light source for lighting glass or acrylic tiles and blocks. Through trial and error, the inventor learned that LEDs required a modification of the basic tile design to receive the LED's. LEDS could be installed underneath the tiles or to form a wall barrier, so once the tiles are in place and are grouted the LED tile assembly becomes permanent. Since the LED's have a life of a several years, the tiles would then have to be removed and the LED's replaced. The inventor recognized that replacement and reinstallation is a very time consuming and costly process that does not make using this type of installation of LED's a very viable option in lighting the glass and acrylic tiles and blocks especially since glass and acrylic are also expensive.

The inventor knew that the blocks could be bored out to form a central cavity. He decided to drill a channel through multiple blocks to support the LEDs and associated wires. After trial and error, the inventor saw that the light diffused through the blocks, as he had expected. However, the diodes and wiring were jumbled up and had no structure. The inventor then decided to provide a separate tubular casing for the diodes and wires. This not only facilitated access to the diodes, but provided additional structural integrity to the channel within the block.

Unfortunately, once the blocks were built to form an illuminated panel, accessing the diodes and wires was still problematic. The inventor decided to create a side door that pivoted to allow access to the channels in each block. The inventor also increased the width of the connectors between the frames that held the diodes and the grout/silicone between the blocks to restrict diffusion of the light.

A benefit of the present invention is that a decorative panel with interchangeable lighting is contained inside each block that forms a panel.

Another benefit is that decorative lighting patterns, messages, and other ornamental and advertising functions are generated by selective lighting of the blocks.

Another benefit is the facilitated access to the lighting from the side of the blocks.

Another benefit is that undesirable light transfusion between blocks is restricted by making the first and second end of the frame solid, creating a snug fit between the frame and the channel, and using grout and silicon between the blocks.

Another benefit is that an inexpensive, easy to manufacture decorative panel is created using a plurality of blocks with internal illumination Color patterned walls and signs have been used for advertising and sending messages, yet none with the present characteristics of the present invention. See: U.S. Pat. No. 5,955,156; U.S. Pat. No. 6,929,382; and U.S. 2006/0197474.

For the foregoing reasons, there is a need for a system and method of creating a decorative panel that will allow high-rise buildings to display illuminated designs that can be changed without the need of contacting cranes or having workers hang from the outside of the buildings to change or work on the designs.

SUMMARY

The present invention describes a system and method of creating a decorative panel. The system and method enables the creation of a decorative panel through a unique arrangement of a plurality of blocks that selectively illuminate. The blocks are arranged to form an illuminating pattern or message. The blocks have a channel located centrally inside. In on embodiment, the channel may be about ½" diameter.

At least one mini tube positions about concentrically inside the channel in the block. The mini tube contains a series of light emitting diodes connected by a central conductive member. Furthermore, to prevent light passing between individual blocks, a plurality of connectors position between the blocks. Any combination of blocks 104*a-b* can selectively block transmission of light. Some of the blocks may be made of wood, concrete or other materials that will allow the builder to highlight designs aspects of the panels constructed. In this manner, a builder can easily construct panels that will highlight a product, service, message, press release on the exterior of top floors of highrise buildings that prior to the invention would have required cranes to place, if at all possible.

The mini tubes are installed in series using a connector-receptor-emitting configuration. These measurements may include ½", ¾", and 1" forming a train of several mini tubes. The illumination from the light emitting diodes is adjustable so as to form the pattern or message without having to remove any of the blocks from the decorative panel. Thus, the illuminating effect from within each block can be configured to create a desired decorative effect for the decorative panel. To restrict passage of light between blocks, one of several mini tubes without glass may be used in its LED metal bars inside electric transmission.

The decorative panel is comprised of a plurality of illuminating blocks that are arranged to form an illuminating pattern or message. The blocks have an internal channel that contains light emitting diodes and wires. The diodes and wires are easily accessible from the edge of the panel by accessing an end frame and sliding the series of frames in and to interchange diodes or maintenance the wires. The illumination from the diodes is adjustable so as to form the desired pattern or message without having to remove a block from the decorative panel.

The system and method enables the creation of a decorative panel through a unique arrangement made up from a plurality of blocks that selectively illuminate to form decorative patterns, text, and messages. Because of the aggregate composition of the panel, the lighting is selective, as each block may or may not illuminate, and the color and pattern for each block may be different. In this manner, myriad combinations of patterns, text, and messages may be formed on the panel.

The blocks have an internal channel that contains light emitting diodes. Thus, the illuminating effect from within each block creates an overall decorative effect for the panel. The diodes are easily accessible from one side of the blocks by sliding them in and out for interchanging diodes or maintenance of the wires. The decorative effect on the panel may be constantly regenerated by interchanging diodes from within individual blocks, without having to move the block. This is possible because the diodes, and the associated wiring, are disposed internally in the blocks.

Each block is defined by a channel that traverses through a central area of the block. It is this channel that contains the illuminating components of the system. The blocks are also defined by a generally transparent disposition, such that light may pass through each block with minimal diffusion or interference from external light sources. The blocks may be arranged in any shape or size, and have any color or lighting pattern to form the final decorative effect on the barrier. This allows the barrier to be created in a variety of shapes, sizes, and dimensions.

Each block is defined by a unique internal illumination generated by a series of light emitting diodes that transmit light in a uniform manner through the transparent surfaces of the block. The diodes are interchangeable and may form myriad creative patterns, colors, and synchronizations. The diodes are housed in a frame, which is itself, snugly housed inside the channel. The frame may be slidably moved through the channels of multiple blocks until aligning with its respective block and forming a snug fit thereto. The diodes and the central conductive member are encased in their own tubes within the frame. Thus, a mini tube contains the series of diodes, while a wiring tube contains the wires.

A plurality of connectors are disposed to position between adjacent frames. The connectors securely fasten the frames together in a series, such that multiple frames can be connected and passed through multiple blocks. The connectors are magnetic to help secure the connections between adjacent frames. The connectors are also conductive, so as to carry electrical current between diodes in adjacent mini tubes. The frames, and thus the internally located diodes and wires are accessible by pivotally detaching an end frame on the edge of the barrier to expose an end frame. The end frame may then be pulled or pushed through the channel to access the frames from their respective channel. Once accessed, the frames can be opened to interchange any diode or wire in the series. The system is powered by at least one power source that is disposed on the edge of the panel, connecting to the wires in the end frame. In this manner, the power source cables and sockets are not visible from a front or rear surface of the blocks.

In some embodiments, the system of creating a decorative panel comprises a plurality of blocks. The blocks form a generally cubicle shape and have a transparent composition. The blocks are defined by a channel that traverses through a center region of each block. The channel may have a generally cylindrical shape. In some embodiments, the system comprises a frame. The frame is defined by a first and second end. Each end has a central receiving aperture, and each end is connected through a first and second frame tube, whereby a generally cylindrical shape is formed. The frame passes through the channel, forming a snug fit within.

In some embodiments, the system comprises a mini tube. The mini tube passes through the central receiving aperture of the frame and is disposed concentrically within the frame. The mini tube is configured to contain a series of diodes that illuminate. The diodes may have any variety of colors and may also illuminate in various patterns. The mini tube is also defined by a substantially transparent composition, such that light passes through.

In some embodiments, the system comprises a plurality of connectors. The plurality of connectors are disposed between the first end and the second end of adjacent frames to form a secure connection between adjacent frames. The connectors are defined by a magnetic composition, wherein the magnetic force helps the connectors fasten adjacent frames together. The connectors are also defined by a conductive composition, wherein the connectors conduct electrical current between diodes in adjacent mini tubes, and wires in adjacent wiring tubes.

Each connector has a first connector end and the second connector end. Each end has a positive pole and a negative pole that align with the similarly charged central conductive member. Furthermore, the electrical current may flow through the wires in series or in parallel, depending on the desired configuration. Nonetheless, in any case, the electrical current powers the diodes to create the decorative illuminating effect for each block.

In some embodiments, the system comprises a panel frame that forms a perimeter around the completed barrier that is arranged from the plurality of blocks. The panel frame is defined by a detachable gate. The detachable gate may include one side end of the panel frame. The detachable gate is configured to pivot between an open position and a closed position to regulate access to the channel in each block. In this manner, the frame with its internal mini tube may be accessed for interchanging diodes or maintenance. In some embodiments, the system comprises at least one power source. The at least one power source is disposed to align along the length of the detachable gate. In this manner, power source wiring and sockets are not visible along the front and rear surface of the blocks.

In an embodiment of the present invention, some of the blocks may be made of wood, concrete, or other materials that will allow the builder to highlight designs aspects of the panels constructed.

An objective of the present invention is to allow a builder to make panels that will highlight a product, service, message, press release on the exterior of top floors of highrise buildings that prior to the invention would have required cranes to place, if at all possible.

One other objective of the present invention is to provide a decorative panel with interchangeable lighting contained inside each block.

Another objective is to create decorative lighting patterns, messages, and other ornamental and advertising functions through the lighting.

Another objective is to provide a series of at least ten diodes for lighting each block.

Another objective is to provide differently colored diodes for each block.

Another objective is to provide facilitated access to the lighting from the side of the blocks.

Another objective is to provide a power source for the lighting form the edges of the blocks, such that the front and rear surface does not have any visible wiring.

Yet another objective is to restrict the diffusion of light between frames by making the first and second end of the frame solid, and creating a snug fit between the frame and the channel.

Yet another objective is to restrict the diffusion of light between blocks by packing grout, cement, or silicone between individual blocks.

Yet another objective is to provide an inexpensive, easy to manufacture decorative panel comprised of multiple illuminating blocks.

DRAWINGS

These and other features, aspects, and advantages of the present invention will become better understood with regard to the following description, appended claims, and drawings where:

DESCRIPTION

Figure 1:
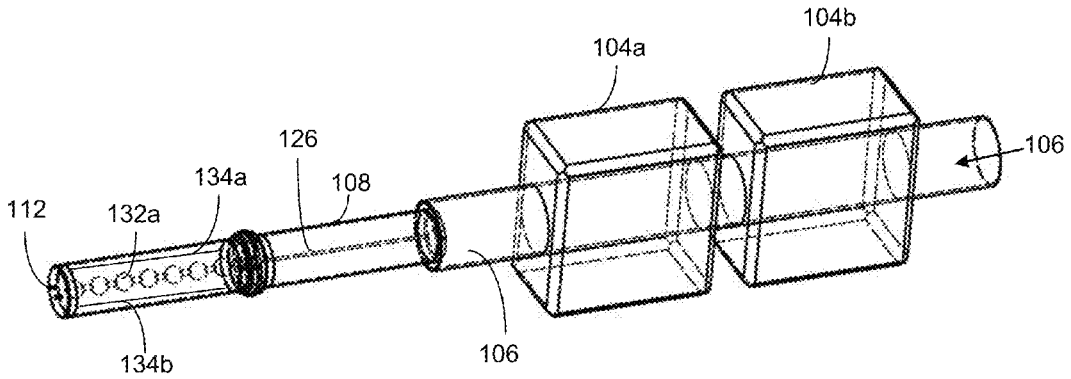
FIG. 1 is a blow up view of an exemplary system for creating a decorative panel, showing an exemplary block, an exemplary inner channel, and an exemplary mini tube.

One embodiment, referenced in FIGS. 1-8, illustrates a system 100 and method 200 for creating a decorative panel. The system 100 and method 200 enables the creation of a decorative panel through a unique arrangement of a plurality of blocks 104*a*, 104*b* that selectively illuminate. The blocks 104*a-b* are arranged to form an illuminating pattern or message. The blocks 104*a-b* have a channel 106 located centrally inside. In on embodiment, the channel 106 may be about ½" diameter.

At least one mini tube 134*a-b* positions about concentrically inside the channel 106 in the block 104*a-b*. The mini tube 134*a-b* contains a series of light emitting diodes 132*a*, 132*b* connected by a central conductive member 136. Furthermore, to prevent light passing between individual blocks, a plurality of connectors 112 position between the blocks 104*a-b*. Some of the blocks 104*a-b* may be made of wood, concrete or other materials that will allow the builder to highlight designs aspects of the panels constructed. Any combination of blocks 104*a-b* can selectively block transmission of light. In this manner, a builder can easily construct panels that will highlight a product, service, message, press release on the exterior of top floors of highrise buildings that prior to the invention would have required cranes to place, if at all possible.

The mini tubes 134*a-b* are installed in series using a connector-receptor-emitting configuration. These measurements may include ½", ¾", and 1" forming a train of several mini tubes 134*a-b*. To restrict passage of light between blocks 104*a-b*, one of several mini tubes without glass may be used in its LED metal bars inside electric transmission.

The illumination from the light emitting diodes 132*a-b* is adjustable so as to form the pattern or message without having to remove any of the blocks 104*a-b* from the decorative panel. Thus, the illuminating effect from within each block 104*a-b* can be configured to create a desired decorative effect for the decorative panel.

As referenced in FIG. 1, the diodes 132*a-b* contained within the blocks 104*a-b* are easily accessible from the side edge of the panel by sliding them in and out to interchange diodes 132*a-b*, or provide maintenance. The decorative effect on the panel may be constantly regenerated by interchanging diodes 132*a-b* from within individual blocks 104*a-b*, without having to move, reorient, or dislodge the blocks 104*a-b*. The blocks 104*a-b* may thus be left in place because the diodes 132*a-b* are disposed internally in the blocks 104*a-b* and accessible from the channel 106 that runs through each individual block 104*a-b*.

The decorative panel, shows a plurality of blocks 104*a-b* that are arranged to create a decorative panel that selectively illuminates to form a message or design. Because of the aggregate composition of the decorative panel, the lighting is selective, as each block 104*a-b* may or may not illuminate, and the color and pattern for each block 104*a-b* may be different. In this manner, myriad combinations of patterns, text, and messages may be formed on the panel. The decorative effect on the panel may be perpetually regenerated by interchanging diodes 132*a-b* from within individual blocks 104*a-b*, without having to move the blocks 104*a-b*. The panel may rest on a panel base for added stability. Though in other embodiments, the panel may hang from a wall, or become a part of a structure.

Additionally, the decorative panel may be employed in a variety of applications including, but not limited to, interior or exterior space illumination in general, direct or indirect illumination of objects or spaces, illumination of displays and/or merchandise for advertising and/or in retail/consumer environments, safety-oriented illumination, theatrical or other entertainment-based/special effects illumination, decorative illumination, combined illumination and communication systems, as well as for various indication and informational purposes.

Figure 2:
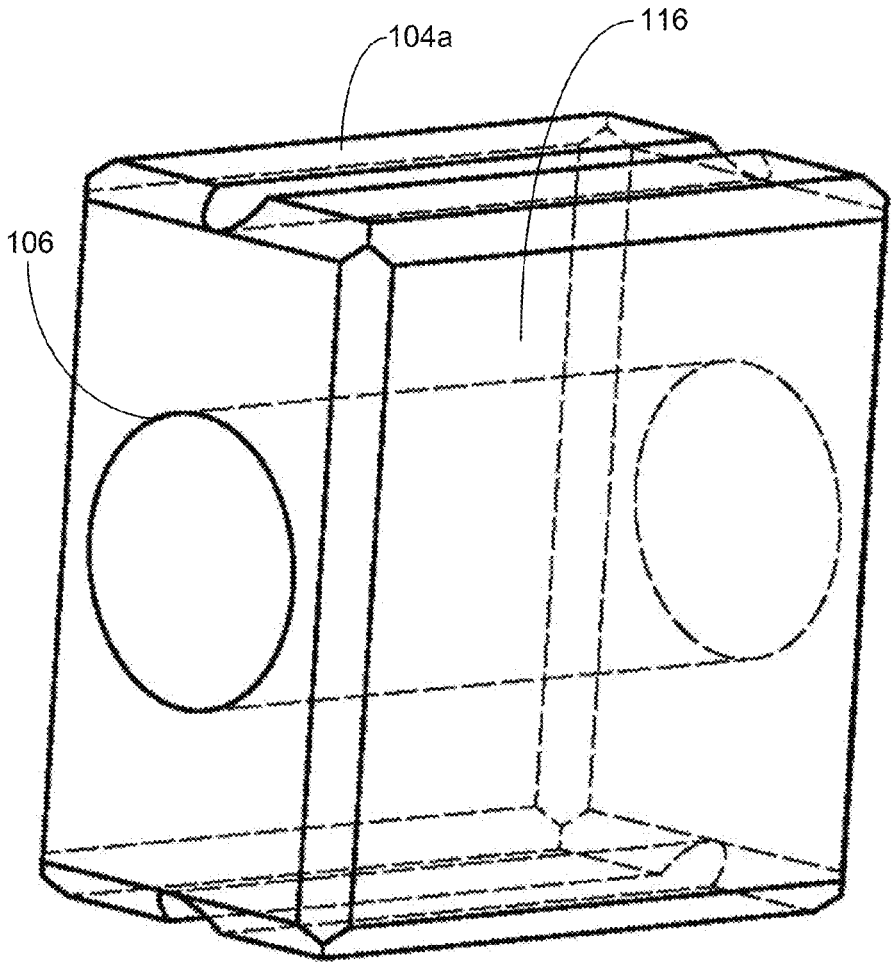
FIG. 2 is a sectioned isometric view of an exemplary block having an exemplary channel to enable passage of an exemplary frame.

Turning now to FIG. 2, each block 104*a-b* comprises a channel 106 that traverses through a central region 116 of the block 104*a*. It is this channel 106 that contains the illuminating components of the system 100. The blocks 104*a-b* are also defined by a generally transparent disposition, such that light may pass through each block with minimal diffusion or interference from external light sources. In one embodiment, the blocks 104*a-b* are fabricated from glass or acrylic.

Multiple blocks 104*a-b* may be arranged with the channels 106 running through each block 104*a-b* being aligned adjacently. The blocks 104*a-b* may be arranged in any shape or size, and have any color or lighting pattern to form the final decorative effect on the panel. This allows the panel to be created in a variety of shapes, sizes, and dimensions. The plurality of blocks 104*a-b* may be set together through various fasteners, including, without limitation, grout, cement, and silicone. The grout, cement, and silicone also serve the dual purpose of restricting diffusion of light between blocks 104*a-b*.

Figure 3:
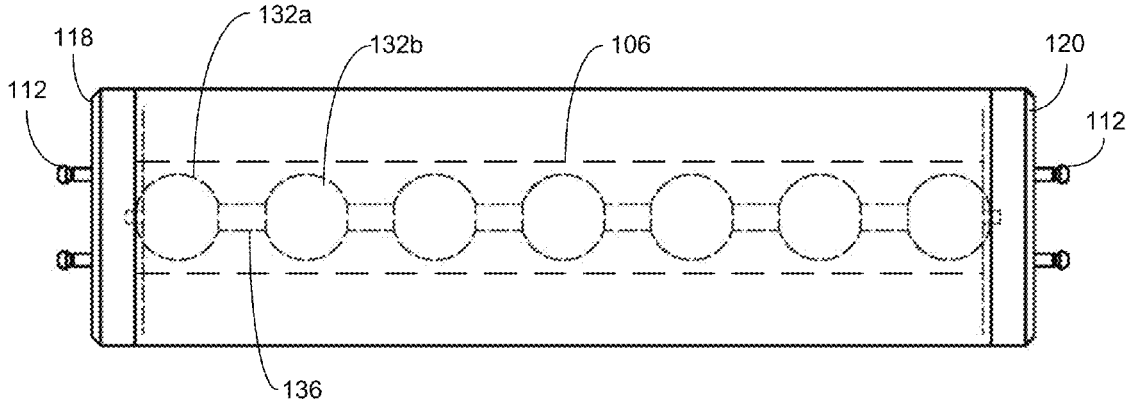
FIG. 3 is a sectioned side view of an exemplary frame with the mini tube.

As illustrated in FIG. 3, each block 104*a-b* is defined by a unique internal illumination generated by a series of light emitting diodes 132*a-b* that transmit light in a uniform manner through the transparent surfaces of the blocks 104*a-b*. The diodes 132*a-b* are interchangeable and may form myriad creative patterns, colors, and synchronizations. The diodes 132*a-b* are housed in a frame 108, which is itself, snugly housed inside the channel 106. The frame 108 may be slidably moved through the channels 106 formed by multiple blocks 104*a-b* until alignment with a respective block 104*a*. This creates a snug fit between the frame 108 and the channel 106. The snug fit serves the dual purpose of restricting diffusion of light between blocks 104*a-b*.

In some embodiments, both the diodes 132*a-b* and the central conductive member 136 are encased in their own tubular casing within the frame 108. Thus, a mini tube 134*a-b* contains the series of diodes 132*a-b*, while a pair of mini tubes 134*a*, 134*b* contains the central conductive member 136. The mini tubes 134*a-b* also serves the function of enhancing structural integrity of the frame 108 and channel 106 inside the blocks 104*a-b*.

In the case when a series of frames 108 are used, a plurality of connectors 112 are disposed to position between adjacent frames 108. The connectors 112 securely fasten the frames 108 together in a series, such that multiple frames 108 can be connected and passed through multiple blocks 104*a-b*. In one embodiment, the connectors 112 are magnetic to help secure the connections between adjacent frames 108. The connectors 112 are also conductive, so as to carry electrical current between diodes 132*a-b* in adjacent mini tubes 134*a-b*, and central conductive member 136 in adjacent wiring tubes 134*a-b*.

In some embodiments, the series of frames 108, and thus the internally located diodes 132*a-b* and central conductive member 136 are accessible by pivotally detaching an end frame on the edge of the panel to expose the frames 108 in their respective blocks 104*a-b*. The end frame terminates a series of adjacent frames 108. Once the end frame is accessed, the other interconnected frames 108 may be pulled out like a string to interchange any diodes 132*a-b* in the series. The system 100 is powered by at least one power source (not shown) that engages the end frame. In this manner, power source cables and sockets are not visible from a front or rear surface of the panel.

In some embodiments, the system 100 of creating a decorative panel may include a plurality of blocks 104*a-b*. The blocks 104*a-b* form a generally cubicle shape and have a transparent composition. In one embodiment, the blocks 104*a-b* are sized to have a length of 8", a height of 8", and a width of 4". The blocks 104*a-b* may be fabricated from glass, acrylic, or any substantially rigid and transparent material known in the art.

As shown in FIG. 2, the blocks 104*a-b* are defined by a channel 106 that traverses through a center region 116 of each block 104*a-b*. A bore drill, may be used to drill the channel 106 through a generally central region of each block 104*a*. The bore drill can have various diameters at a drill head to form a 2" or ½" diameter channel 106. In some embodiments, the channel 106 may have about a 2" diameter, or a ½" diameter. However, other diameter sizes may be bored out of the block 104*a* to form the channel 106. The channels 106 are generally aligned in adjacent blocks 104*a-b*, such that the frame 108 may pass through multiple blocks 104*a-b* simultaneously. The channel 106 may have a generally cylindrical shape. However in other embodiments, other shapes may be bored out of the blocks 104*a-b*.

Turning now to FIG. 3, the system 100 comprises a frame 108. The frame 108 is configured to pass through the channel 106. In one embodiment, the frame 108 passes through multiple channels 106 before securely positioning in its appropriate block 104*a-b*. The frame 108 has substantially the same shape (cylindrical) as the channel 106, such that it forms a snug fit therein. The snug fit helps restrict loss of illumination from within the frame 108.

The frame 108 is defined by a first end 118 and a second end 120. The ends 118, 120 are generally circular and connected by a first frame tube and a second frame tube that extends therebetween. In one possible embodiment, the first end 118, has a central receiving aperture 126 that enables passage of additional components in and out of the frame 108. The ends 118, 120 of the frame 108 may have two protrusions and/or two depressions that rotatably mate with a plurality of connectors 112. Thus, multiple frames 108 may be attached together in series through a plurality of connectors 112 (FIG. 3).

The first and second end 118, 120 of the frame 108 are connected through a first frame tube and a second frame tube, whereby the generally cylindrical shape discussed above is formed. This shape allows the frame 108 to pass through the channel 106, forming a snug fit within. In one embodiment, the frame 108 has a diameter of about 2". However, the frame 108 may also have a diameter of about ½" to match the diameter size of the channel 106.

In some embodiments, the system 100 comprises a mini tube 134*a-b*. The mini tube 134*a-b* passes through the central receiving aperture 126 of the frame 108 and is disposed concentrically within the frame 108. The mini tube 134*a-b* is configured to contain a series of diodes 132*a-b* that illuminate.

In one embodiment, the series of diodes 132*a-b* consists of at least ten diodes arranged in linear connectivity. The mini tube 134*a-b* freely moves in and out of the frame 108 for changing and maintenance of the diodes 132*a-b*. The mini tube 134*a-b* is also defined by a substantially transparent composition, such that light from the diodes 132*a-b* is allowed to pass through with minimal diffusion or interference. However, a coloring or diffusion composition may be added to the surface of the mini tube 134*a-b* to alter the lighting.

Those skilled in the art will recognize that the diodes 132*a-b* contained within the mini tube 134*a-b* may include any number of light emitting diodes 132*a-b* known in the art, including semi-conductor and organic light emitting diodes. The diodes may be configured to generate radiation in one or more of the infrared spectrum, ultraviolet spectrum, and various portions of the visible spectrum. In general, the generated radiation wavelengths are from approximately 400 nanometers to approximately 700 nanometers. Some possible examples of diodes may include, without limitation, various types of infrared diodes, ultraviolet diodes, red diodes, blue diodes, green diodes, yellow diodes, amber diodes, orange diodes, and white diodes. It also should be appreciated that the diodes may be configured to generate radiation having various bandwidths for a given spectrum, e.g., narrow bandwidth, broad bandwidth. The diodes 132*a-b* of the present invention may illuminate in a steady pattern or a synchronized, pulsating pattern.

Figure 4:
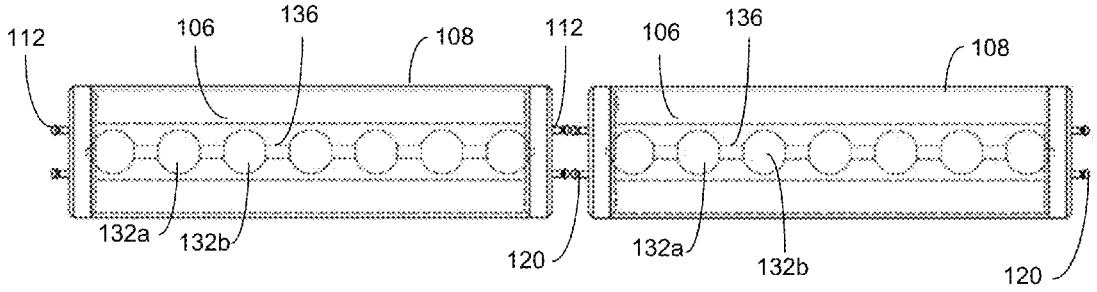
FIG. 4 is a sectioned side view of two frames, with each frame interconnecting a mini tube.

As shown in FIG. 4, the frame 108 snugly fits into the channel 106, while the mini tube 134*a-b* and the wiring tubes 134*a-b* position inside the frame 108. This slidable arrangement between the components facilitates access to the diodes 132*a-b* and the central conductive member 136. In one alternative embodiment, the pair of wiring tubes 134*a-b* and the mini tube 134*a-b* are encased in their own tubular casing, which then itself slidably enters inside the frame 108. However, in either case, the pair of wiring tubes 134*a-b* provide structural integrity along the length of the frame 108.

Figure 5:
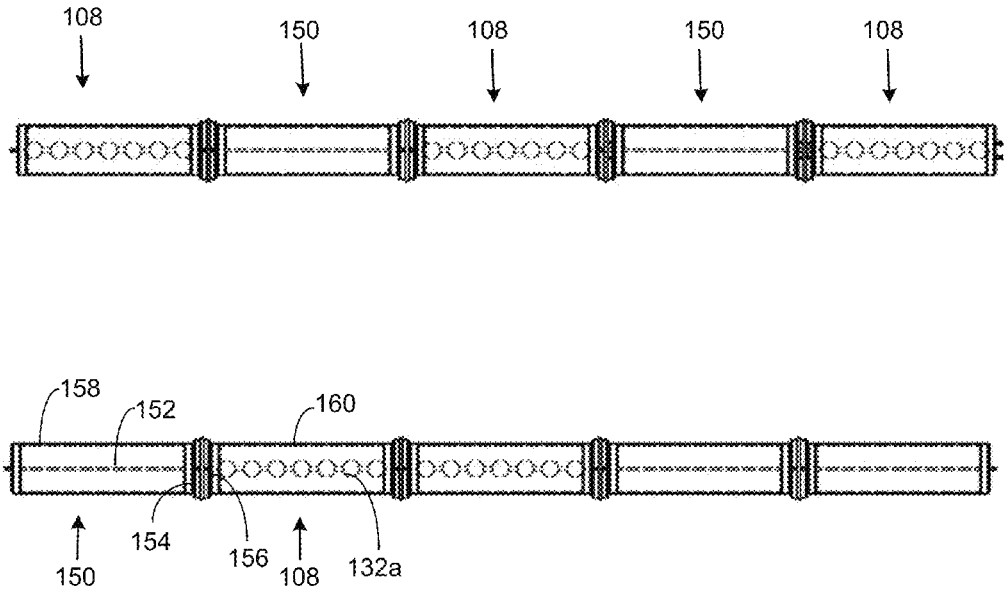
FIG. 5 is a side view of two sets of frames, with each frame interconnecting a mini tube.

As referenced in FIG. 5, the central conductive member 136 carries electrical current through the frames 108 in a series, wherein the electrical current follows a single path through the central conductive member 136 and the diodes 132*a-b* for all of the frames 108. In the series wiring configuration, the current through the central conductive member 136 and diode 132*a-b* is the same and the voltage across each diode 132*a-b* is different.

In another possible embodiment, the central conductive member 136 carry the electrical current in parallel, wherein the electrical current follows a single path through the central conductive member 136 and the diodes 132*a-b* for all of the frames 108. In the parallel configuration, the voltage across the central conductive member 136 and the series of diode 132*a-b* is the same and the current through each wire 136 and diode 132*a-b* is different. It is significant to note that the parallel configuration of wiring does not utilize the pair of wiring tubes 134*a-b*, but rather has the wires 136 run through the series of diodes 132*a-b*.

In some embodiments, the system 100 may include a plurality of connectors 112. The connectors 112 are disposed between the first end 118 and the second end 120 of adjacent frames 108 to form a secure connection between the frames 108. In some embodiments, the connectors 112 have a width that is generally equivalent to the thickness of the grout or silicone between the blocks 104*a-b*. This solid width creates a light barrier that restricts the loss of light form the diodes 132*a-b*.

In some embodiments, the connectors 112 may have a magnetic composition. The magnetic force that is generated helps the connectors 112 fasten adjacent frames 108 together. However, in other embodiments, the connectors 112 may be threaded, so as to enable rotatable fastening with the frames 108. In yet additional embodiments, clips, screws, and frictional compression may be used to fasten the connectors 112 to the frames 108. The connectors 112 are also defined by a conductive composition, wherein the connectors 112 conduct electrical current between diodes 132*a-b* in adjacent mini tubes 134*a-b*, and central conductive member 136.

Each connector 112 has a first connector end that tapers into a second connector end. In some embodiments, the first connector end may include a U-shaped slot for receiving the first end 118 of the frame 108. The second connector end has a positive pole and a negative pole that align with the similarly charged central conductive member 136. Furthermore, the electrical current may flow through the central conductive member 136 in a series or parallel wiring configuration, depending on the desired configuration. In the parallel wiring configuration the central conductive member 136 are carried by the mini tube 134*a-b*. In either the series or parallel wiring configuration, however, the electrical current runs through the central conductive member 136 to power the diodes 132*a-b*, and thereby create the decorative illuminating effect for the blocks 104*a-b*.

In one alternative embodiment, at least one conductor frame 150 is used solely for conducting electrical current. The conductor frame 150 does not contain diodes 132-*b*, and thus does not illuminate. However, the conductor frame 150 may join with an adjacent frame 108 that does have diodes 132*a-b*. The conductor frame 150 is configured to not contain the mini tube 134*a-b* or the wiring tubes 134*a-b*. Rather the conductor frame 150 holds a conductor 152. This allows for continuing the flow of electrical current without providing illumination from the respective block 104*a*.

Figure 6:
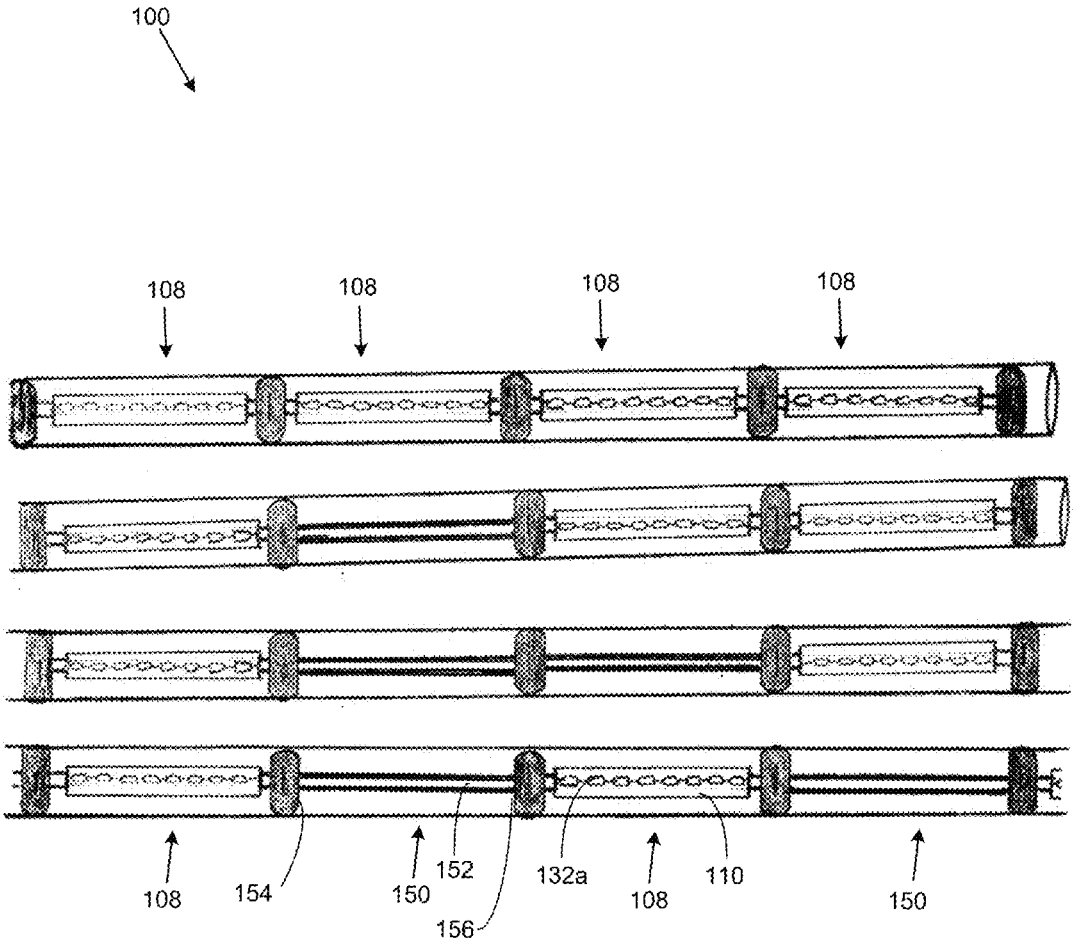
FIG. 6 is a sectioned side view of two frames, with multiple frames interconnecting multiple mini tubes.

FIG. 6 illustrates an alternating arrangement between conductor frames 150 with diodes 132*a-b* and conductor frames 150 having no diodes 132*a-b*. The conductor frames 150 are adjacently joined within their respective blocks 104*a-b*. The conductor frames 150 are also fastened within their respective blocks 104*a-b*. This configuration can create greater flexibility in illuminating text. For example, a completed panel having an alternating arrangement between blocks 104*a* that illuminate and blocks 104*b-c* that do not illuminate. The capacity of the blocks 104*a-b* to selectively illuminate, thus enable the formation of the aforementioned text, patterns, and messages on the decorative panel.

The at least one conductor frame 150 has a first conductor end 154 and a second conductor end 156. Each end 154, 156 of the conductor frame 150 is connected by a first conductor tube 158 and a second conductor tube 160. The conductor frame 150 further includes a generally concentrically disposed elongated conductor 152 that extends between the first conductor end 154 and the second conductor end 156. The conductor 152 may form a pair of metal rods that carries the current form an adjacent central conductive member 136. The conductor frame 150 may be used when the central conductive member 136 is configured in series or parallel, as discussed above.

In one embodiment, the panel comprises a panel frame that forms a perimeter around the completed panel arranged from the plurality of blocks 104*a-b*. The panel frame is defined by a detachable gate. The detachable gate may include one side end of the panel frame 114. The detachable gate is configured to pivot between an open position and a closed position to regulate access to the channel 106, and thus the end frame for each block 104*a-b*. In this manner, all of the frames 108, including the internally disposed mini tube 134*a-b*, may be accessed to change out diodes 132*a-b* or maintenance the central conductive member 136. The detachable gate may also have a plurality of gate apertures that are evenly spaced along the length of the detachable gate. The gate apertures enables the central conductive member 136, and also allow the power source cable to pass through.

In some embodiments, the system 100 comprises at least one power source. The at least one power source may include a socket, a power cable, a condenser, a resistor, and other electrical components that regulate and carry the electrical current to and from the central conductive member 136 and diodes 132*a-b*. The power source is disposed to align along the length of the detachable gate. In this manner, power source wiring and sockets are not visible along the front and rear surface of the blocks 104*a-b*. The at least one power source may include a condenser to store electrical power before dispensing to the various frames 108 in the blocks 104*a-b*. A resistor may also be positioned proximally to the frames 108 to regulate the amount of electrical current that is allowed to flow into the central conductive member 136 and the diodes 132*a-b*.

Figure 7A:
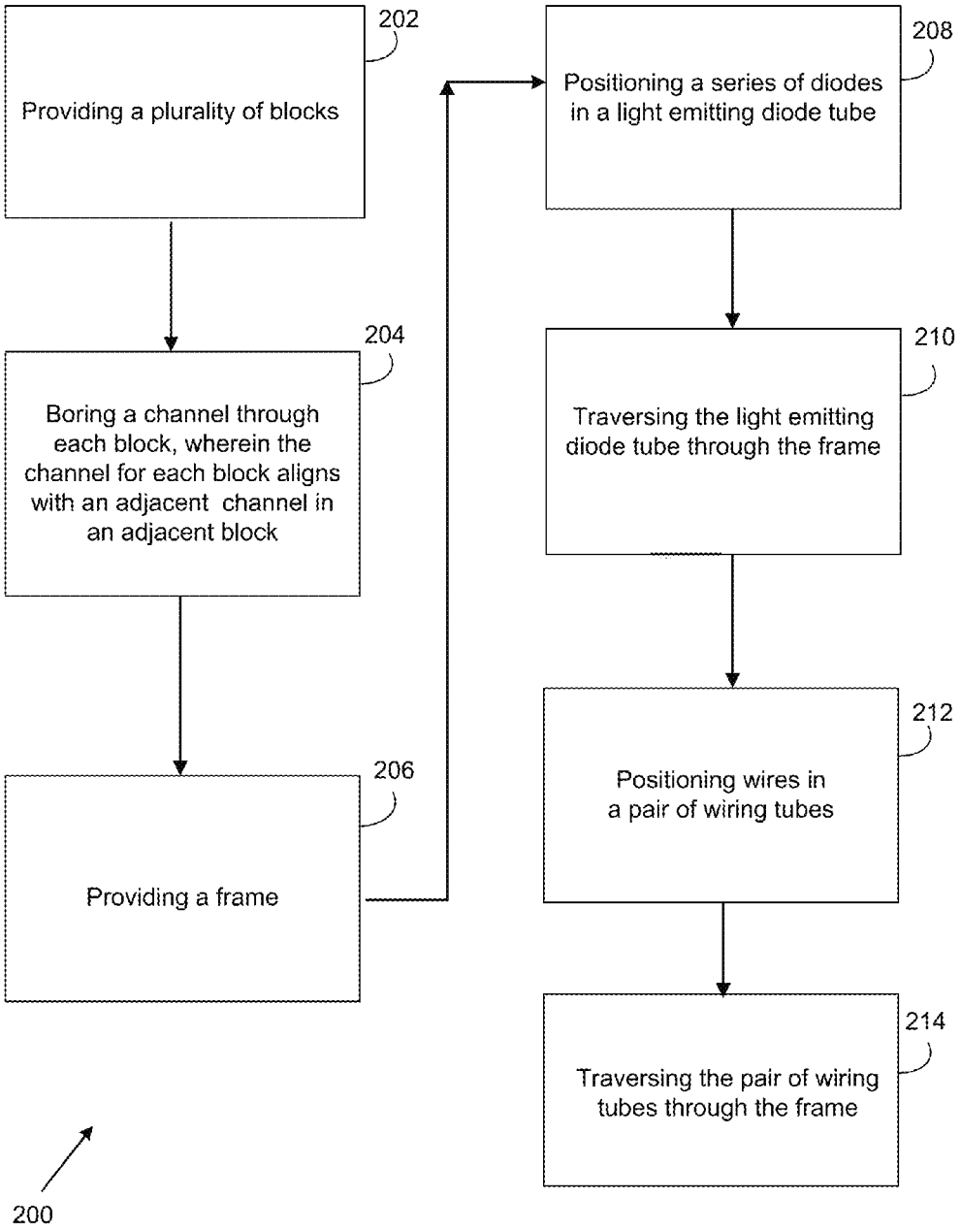
FIGS. 7A and 7B are flowchart diagrams of an exemplary method of creating a decorative panel.
Figure 7B:
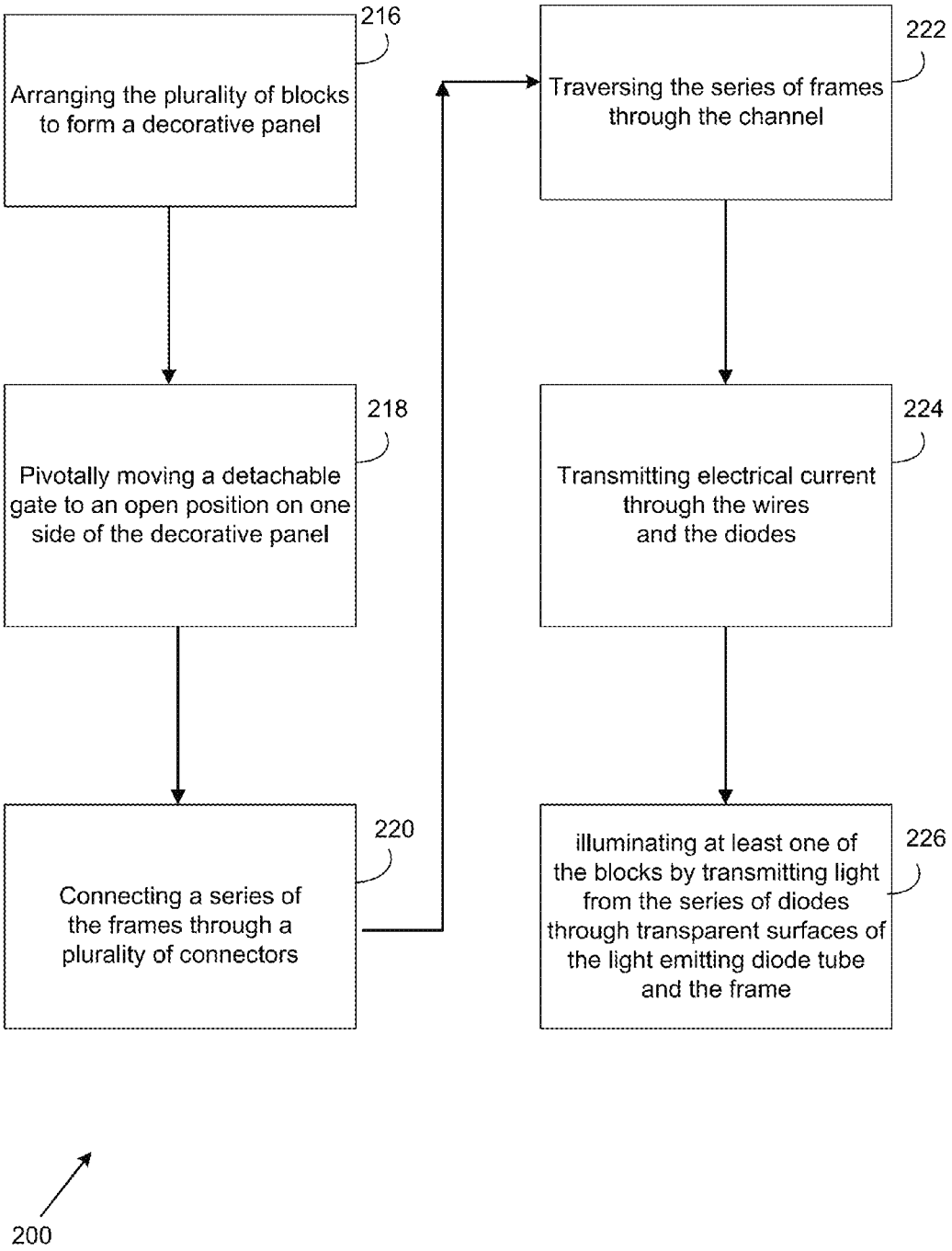
Figure 8:
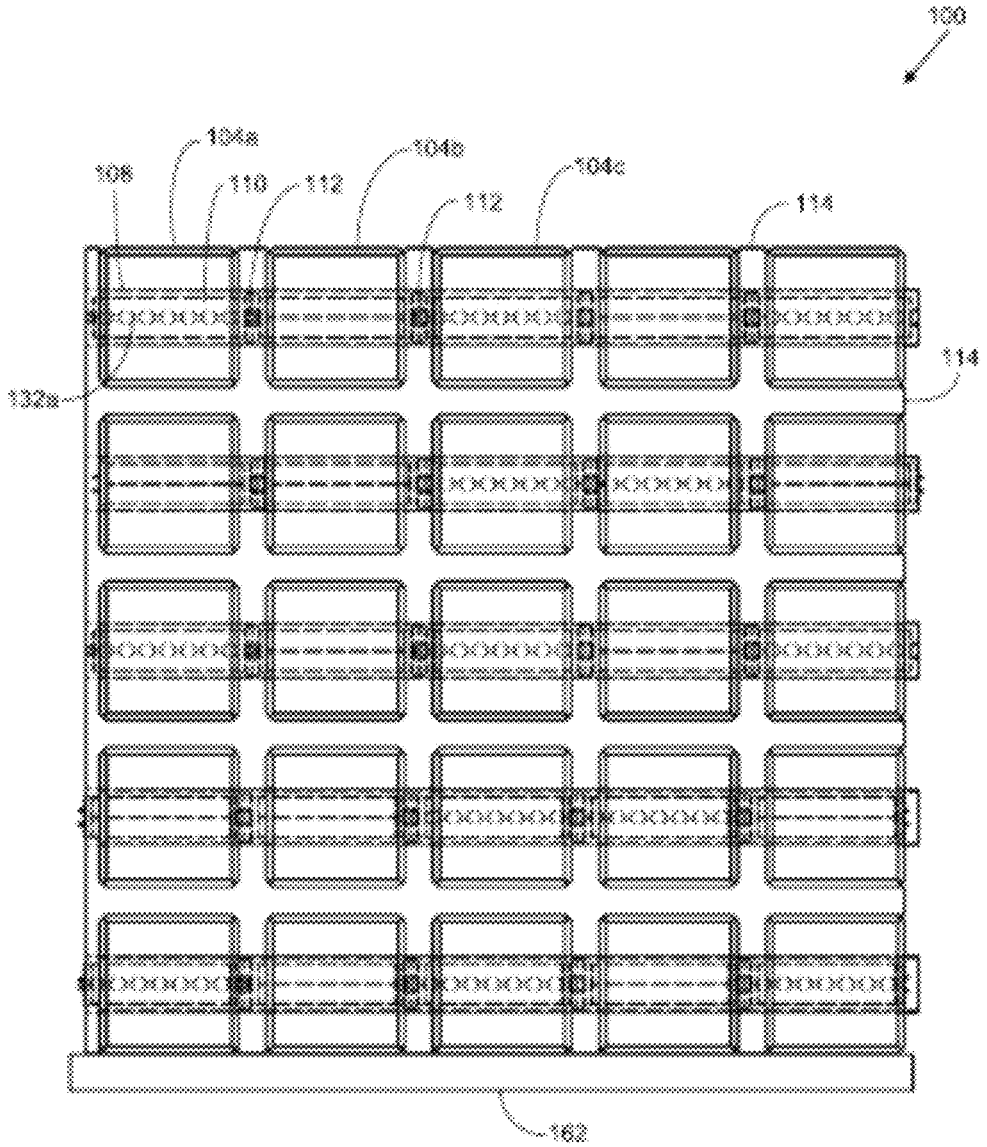
FIG. 8 is a front view of an exemplary system of creating a decorative panel, where a plurality of blocks are arranged to form a barrier.

FIGS. 7A and 7B illustrate a flowchart diagram of an exemplary method 200 for creating a decorative panel. The method 200 includes arranging of a plurality of illuminating blocks 104*a-b* into a variety of shapes and sizes to form a decorative panel. The blocks 104*a-b* contain internal light emitting diodes 132*a-b* that are interchangeable and easily accessible, along with the associated wiring and circuitry. Thus, the illuminating effect from within each block 104*a* creates an overall decorative effect for the panel.

The method 200 may include an initial Step 202 of providing a plurality of blocks 104*a-b*.

The method 200 may further comprise a Step 204 of boring a channel 106 through each block, wherein the channel 106 for each block aligns with an adjacent channel 106 in an adjacent block. A bore drill may create the channel 106. The channels 106 for multiple blocks 104*a-b* align so as to allow additional components to pass through.

A Step 206 includes providing a frame 108. The frame 108 is configured to pass through the channel 106. In one embodiment, the frame 108 passes through multiple channels 106 before securely positioning in its appropriate block 104*a-b*. The frame 108 has substantially the same shape (cylindrical) as the channel 106, such that it forms a snug fit therein. The snug fit helps restrict loss of illumination from within the frame 108.

In some embodiments, a Step 208 comprises positioning a series of diodes 132*a-b* in a mini tube 134*a-b*. The mini tube 134*a-b* passes through the central receiving aperture 126 of the frame 108 and is disposed concentrically within the frame 108. The mini tube 134*a-b* is configured to contain a series of diodes 132*a-b* that illuminate. The diodes 104*a-b* may include at least 10 diodes that string through the mini tube 134*a-b*.

A Step 210 includes traversing the mini tube 134*a-b* through the frame 108. The mini tube 134*a-b* not only holds the diodes 132*a-c*, but also provides structural integrity to the frame 108.

In some embodiments, a Step 212 may include positioning central conductive member 136 in a pair of wiring tubes 134*a-b*. The pair of wiring tubes 134*a-b* are disposed to position on opposite sides of the mini tube 134*a-b*, and towards the periphery of the frame 108. The pair of wiring tubes 134*a-b* contain central conductive member 136 that carry electrical current to power the diodes 132*a-b*.

A Step 214 comprises traversing the pair of wiring tubes 134*a-b* through the frame 108. The pair of wiring tubes 134*a-b* not only holds the central conductive member 136, but also provides structural integrity to the frame 108. A Step 216 includes arranging the plurality of blocks 104*a-b* to form a decorative panel. The blocks 104*a-b* are held together by various fasteners, including, without limitation, cement, grout, and silicone. General brick laying skills known in the art may be used to configure the blocks 104*a-b*.

The method 200 may further include a Step 218 that includes pivotally moving a detachable gate to an open position on one side of the decorative panel, the panel comprises a panel frame that forms a perimeter around the completed panel arranged from the plurality of blocks 104*a-b*. The panel frame is defined by a detachable gate. The detachable gate may include one side end of the panel frame. The detachable gate is configured to pivot between an open position and a closed position to regulate access to the channel 106, and thus the end frame for each block 104*a-b*. In this manner, all of the frames 108, including the internally disposed mini tube 134*a-b* and wiring tubes 134*a-b*, may be accessed to change out diodes 132*a-b* or maintenance the central conductive member 136.

In some embodiments, a Step 220 comprises connecting a series of the frames 108 through a plurality of connectors 112. The connectors 112 are disposed between the first end 118 and the second end 120 of adjacent frames 108 to form a secure connection between the frames 108.

A Step 222 includes traversing the series of frames 108 through the channel 106. The frames 106, which now hold diodes 132*a-b* and central conductive member 136 traverse through the channels 106 of individual blocks 104*a-b* and align with a respective block. The series of frames 106 may be extended at any time by connecting additional frames 106 to the terminus.

In some embodiments, a Step 224 may include transmitting an electrical current through the central conductive member 136 and the diodes 132*a-b*. The panel comprises at least one power source. The at least one power source may include a socket, a power cable, a condenser, a resistor, and other electrical components that regulate and carry the electrical current to and from the central conductive member 136 and diodes 132*a-b*. The power source is disposed to align along the length of the detachable gate.

A final Step 226 comprises illuminating at least one of the blocks 104*a-b* by transmitting light from the series of diodes 132*a-b* through transparent surfaces of the mini tube 134*a-b* and the frame 108. The decorative effect on the panel may be perpetually regenerated by interchanging diodes 132*a-b* from within individual blocks 104*a-b*, without having to move the block. The panel may rest on a panel base for stability. Additionally, the decorative panel may be employed in a variety of applications, including advertising signage and public events.

In another embodiment of the present invention, some of the blocks may be made of wood, concrete or other materials that will allow the builder to highlight designs aspects of the panels constructed.

While the inventor's above description contains many specificities, these should not be construed as limitations on the scope, but rather as an exemplification of several preferred embodiments thereof. Many other variations are possible. For example, the channel 106 and the frame 108 may take a cubicle shape, so as to provide a different diffusion of light from inside the blocks 104*a-b*. Accordingly, the scope should be determined not by the embodiments illustrated, but by the appended claims and their legal equivalents.

What is claimed is:

1. A system of creating decorative panels, the system comprises:

a plurality of blocks, the plurality of blocks defined by a channel that traverses through a center region of each block, a portion of the plurality of blocks having a generally transparent composition, and a portion of the plurality of blocks having a generally opaque composition;

a frame, the frame disposed concentrically in the channel, the frame defined by a first end and a second end, each end defined by a central receiving aperture;

at least one mini tube, the at least one mini tube disposed concentrically inside the frame, the at least one mini tube defined by a substantially transparent composition, the at least one mini tube configured to contain a series of diodes;

a central conductive member, the central conductive member disposed to position on opposite sides of the at least one mini tube, the central conductive member configured to carry current to the series of diodes; and a plurality of connectors, the plurality of connectors disposed between the first end and the second end of adjacent frames, the plurality of connectors defined by a magnetic composition, the plurality of connectors configured to fasten adjacent frames together, the plurality of connector further configured to restrict passage of light between adjacent blocks, wherein the light from the series of diodes is shielded between individual blocks.

2. The system of claim 1, wherein the series of diodes form a ¼ inch chain in a connector-receptor-emitting series configuration.

3. The system of claim 1, wherein the plurality of blocks are fabricated from wood, cement, or a transparent material.

4. The system of claim 1, wherein the plurality of blocks are fastened together by at least one member selected from the group consisting of: cement, grout, concrete, and silicone.

5. The system of claim 1, wherein the channel has a diameter of about 2 inches.

6. The system of claim 1, wherein the channel is acrylic or a transparent material.

7. The system of claim 1, wherein the plurality of blocks have dimensions of about 8 inches length, 8 inches height, and 4 inches width that substantially form a cube shape.

8. The system of claim 1, wherein the plurality of blocks are interconnected to form a barrier.

9. The system of claim 1, wherein the frame has a substantially cylindrical shape.

10. The system of claim 1, wherein the mini tube is disposed to pass through the central receiving aperture in the frame.

11. The system of claim 1, wherein the series of diodes is ten diodes.

12. The system of claim 1, wherein the color of the diodes for each frame is different.

13. The system of claim 1, wherein the central conductive member is disposed to pass through the central receiving aperture in the frame for operatively connecting to the series of diodes in the at least one mini tube.

14. The system of claim 1, wherein the central conductive member carries electrical current in a series, wherein the electrical current follows a single path through the central conductive member and the series of diodes for all of the frames, and wherein the current through each central conductive member and diode is the same and the voltage across each central conductive member and diode is different.

15. The system of claim 1, wherein the plurality of connectors have a first connector end and a second connector end.

16. The system of claim 15, wherein the first connector end and the second connector end each have a positive pole and a negative pole that align with the similarly charged wires in the pair of wiring tubes.

17. The system of claim 1, further including at least one power source, the at least one power source disposed to align along the length of the detachable gate, wherein a power source cable and socket are not visible along a front and rear surface on the plurality of blocks.

18. The system of claim 1, further including a panel frame, the panel frame composed of the plurality of blocks.

19. The system of claim 18, wherein the panel frame is defined by a detachable gate, the detachable gate configured to pivotally move between an open position and a closed position to regulate access to the channel in each block.

20. A system of creating decorative panels, the system comprises:

a plurality of blocks, the plurality of blocks defined by a channel that traverses through a center region of each block, a portion of the plurality of blocks having a generally transparent composition, and a portion of the plurality of blocks having a generally opaque composition;

a frame, the frame disposed concentrically in the channel, the frame defined by a first end and a second end, each end defined by a central receiving aperture;

at least one mini tube, the at least one mini tube disposed concentrically inside the frame, the at least one mini tube defined by a substantially transparent composition, the at least one mini tube configured to contain a series of diodes;

a central conductive member, the central conductive member disposed to position on opposite sides of the at least one mini tube, the central conductive member configured to carry current to the series of diodes;

a plurality of connectors, the plurality of connectors disposed between the first end and the second end of adjacent frames, the plurality of connectors defined by a magnetic composition, the plurality of connectors configured to fasten adjacent frames together, the plurality of connector further configured to restrict passage of light between adjacent blocks, wherein the light from the series of diodes is shielded between individual blocks;

a panel frame, the panel frame defined by a detachable gate, the detachable gate configured to pivotally move between an open position and a closed position to regulate access to the channel in each block; and at least one power source, the at least one power source disposed to align along the length of the detachable gate, wherein a power source cable and socket are not visible along a front and rear surface on the plurality of blocks.

* * * * *